United States Patent [19]

Webbon

[11] 4,007,601

[45] Feb. 15, 1977

[54] TUBULAR SUBLIMATOR/EVAPORATOR HEAT SINK

[75] Inventor: Bruce W. Webbon, San Jose, Calif.

[73] Assignee: The United States of America as represented by the Administrator of the National Aeronautics and Space Administration, Washington, D.C.

[22] Filed: Oct. 16, 1975

[21] Appl. No.: 623,187

[52] U.S. Cl. ..... 62/100; 62/121; 62/269; 62/315

[51] Int. Cl.[2] ..... F25B 19/00; F28C 1/00

[58] Field of Search ..... 62/100, 268, 269, 315, 62/121, 404, 467

[56] References Cited

UNITED STATES PATENTS

| | | | |
|---|---|---|---|
| 1,285,415 | 11/1918 | Schou | 62/269 |
| 2,182,788 | 12/1939 | Cornell, Jr. | 62/315 |
| 2,461,636 | 2/1949 | Gaylor | 62/315 |
| 3,079,765 | 3/1963 | Vantine | 62/259 |
| 3,170,303 | 2/1965 | Rannenberg et al. | 62/315 |
| 3,196,634 | 7/1965 | Rich | 62/315 |
| 3,197,973 | 8/1965 | Rannenberg et al. | 62/315 |
| 3,362,186 | 1/1968 | Patterson | 62/315 |
| 3,403,531 | 10/1968 | Oesterheld | 62/121 |
| 3,543,411 | 11/1968 | Bardsley et al. | 62/268 |

*Primary Examiner*—Lloyd L. King
*Attorney, Agent, or Firm*—Darrell G. Brekke; Gary F. Grafel; John R. Manning

[57] ABSTRACT

An evaporative refrigerator or cooler comprising a bundle of spaced, porous walled tubes closed at one of their ends and vented to a vacuum at the other end is disclosed. The tube bundle is surrounded by a water jacket having a hot water inlet distribution manifold and a cooled water outlet through a plenum chamber. In operation, hot water is pumped into the jacket to circulate around the tubes, and when this water meets the vacuum existing inside the tubes, it evaporates thereby cooling the water in the jacket. If cooling proceeds to the point where water penetrating or surrounding all or part of the tubes freezes, operation continues with local sublimation of the ice on the tubes while the circulating water attempts to melt the ice. Under some conditions, both sublimation and evaporation may take place simultaneously in different regions of the device.

8 Claims, 2 Drawing Figures

TUBULAR SUBLIMATOR/EVAPORATOR HEAT SINK

STATEMENT OF ORIGIN

The invention described herein was made by an employee of the United States Government and may be manufactured and used by or for the Government for Governmental purposes without the payment of any royalties thereby or therefor.

BACKGROUND OF THE INVENTION

1. Field of the Invention

This invention relates to heat sinks for cooling fluids suitable for operation in high altitude environment situations such as outer space.

2. Prior Art

Many attempts for providing heat sink devices for use in conjunction with a variety of environments are known. These devices find utilization in many diverse areas: cooling towers, air conditioning, space suits, and the like. In general, the use of a cooling fluid or source of low pressure is utilized to stimulate heat transfer. A most basic technique merely uses the passage of air to create a surface where evaporation may occur to facilitate cooling of a liquid. Other basic techniques rely on sublimation as the thermodynamic effect cooling the liquid. In practical application, heat sinks for cooling fluids may take the form of many different configurations. These devices can generally be categorized as metal porous plate sublimators, foam sublimators, spraying flash evaporators, wick-fed water boilers and membrane evaporator/sublimators. The metal plate and foam sublimators both use flat plate sublimation surfaces, and in terms of size are relatively large for a given heat rejection rate. Also, both systems require a finite time from the start of the operation until the system reaches a full capacity operation. In contrast, the spraying flash evaporator has an extremely short start-up time, but it requires a large volume and control system with moving parts rather than being self-regulating as are the metal plate and foam sublimators.

The wick-fed water boiler technique requires active control of the evaporation chamber pressure which is difficult to achieve with a compact reliable system. The membrane evaporator/sublimator is the most similar of the prior art approaches to this invention and uses a number of small tubes made of a water-permeable membrane material. The water is pumped through the inside of the tubes while the tube exterior is exposed to a pressure below the water's saturation pressure. Water then migrates through the tube wall to the outer surface where it evaporates, cooling the water remaining inside the tube. The major disadvantage of this approach is that excess cooling, such as occurring during operation at low heat rejection rates or in case of failure of the backpressure control system, may cause freezing of the water remaining in the tubes. This situation can result in stoppage of water circulation and breaking of the tubes.

Within the patent literature, many of these concepts are described. U.S. Pat. No. 3,170,303, Rannenberg et al, shows a porous plate sublimator, and an improvement, U.S. Pat. No. 3,197,973, shows sublimation cooling through a porous walled tube with a vacuum applied to the outside surface of the tube. As shown in FIG. 2 of this patent, the sublimator has an outer wall made from a porous material such as sintered nickel or stainless steel. A series of helices are placed in the chamber to agitate the refrigerant for increased surface effect.

The mode of operation in the Rannenberg et al devices is with the initial operation starting with a solid plug of ice in the passage 52. Sublimation occurs with the application of heat, and, as a result, the ice layer is reduced. A flow of water, once it encounters the subcooled passage wall 50, freezes thereby forming a new plug of ice to renew the cycle.

U.S. Pat. No. 3,403,531 to Oesterheld discloses an evaporation device where liquid to be cooled flows over the outside of a stack of porous tubes and the liquid is absorbed by the tubes. A chimney device, adjacent to the tubes, draws air through the tubes to evaporate small amounts of liquid. The cooling effect, as a function of evaporation, then cools the liquid passing over the outer surfaces of the tube. Similarly, U.S. Pat. No. 3,079,765 to LeVantine discloses a space unit utilizing the evaporation principle to cool liquid absorbed by a network of tubes made from a sponge-like substance when the liquid is in communication with a source of low pressure.

SUMMARY OF THE INVENTION

The tubular sublimator/evaporator system of this invention departs from the prior art in several critical concepts. First, the relative position of the circulating liquid evaporant and the low pressure vapor passages are reversed. In the present invention, the liquid flows around the outside of the tubes while the tube interior is vented directly to a vacuum. This approach requires no active control of the vapor pressure under any circumstances. In the basic configuration, the device comprises a core having a bundle of tubes, each tube being sealed at one end with the other end vented to a vacuum through a plenum chamber. The evaporant circulates through a container that encloses the tube bundles, and a part of the water is evaporated through the tube walls.

The tubes themselves must be considerably larger than those used in prior art membrane evaporator/sublimators since they are required to flow vapor at a low pressure rather than liquid. The tubes can be constructed of a hydrophobic or hydrophilic membrane material, a metal or glass with controlled porosity, or a foam with a supporting screen.

The operation of the invention is such that under most conditions it functions as an evaporator since the pressure drops and the sonic, choked flow effect in the vapor flowing out through the tubes is sufficient to maintain the saturation pressure at the tube walls above the triple point of water (0.088 psia). As the heat load is decreased, the pressure in the tubes drops until ice forms on the tube wall. The device then functions as a sublimator. However, the tube spacing and flow arrangement is such that this ice will not prevent the flow of liquid under any combination of heat load and liquid temperature within the design parameters of the system. The resulting volume change as a result of the formation of ice is accommodated by a liquid accumulator. The liquid flowing around the tubes is effectively cooled to account for any increase in liquid temperature or flow rate caused by a heat load transient.

Hence, it is an object of this invention to provide a cooling device that is self-regulating, more compact and more reliable than prior art systems.

Another object of this invention is to provide a cooling system which eliminates flow stoppage and tube breakage caused as a result of freezing inside a tube containing liquid.

Yet another object of this invention is to provide a device not requiring a vapor pressure controller to prevent freezing.

A further object of this invention is to provide a system having a large heat transfer rate to function as a heat sink in high altitude environments such as outer space.

The specific nature of the invention, as well as other objects, aspects, uses and advantages thereof, will clearly appear from the following description and from the accompanying drawings, in which:

DESCRIPTION OF THE PREFERRED EMBODIMENT

Figure 1:
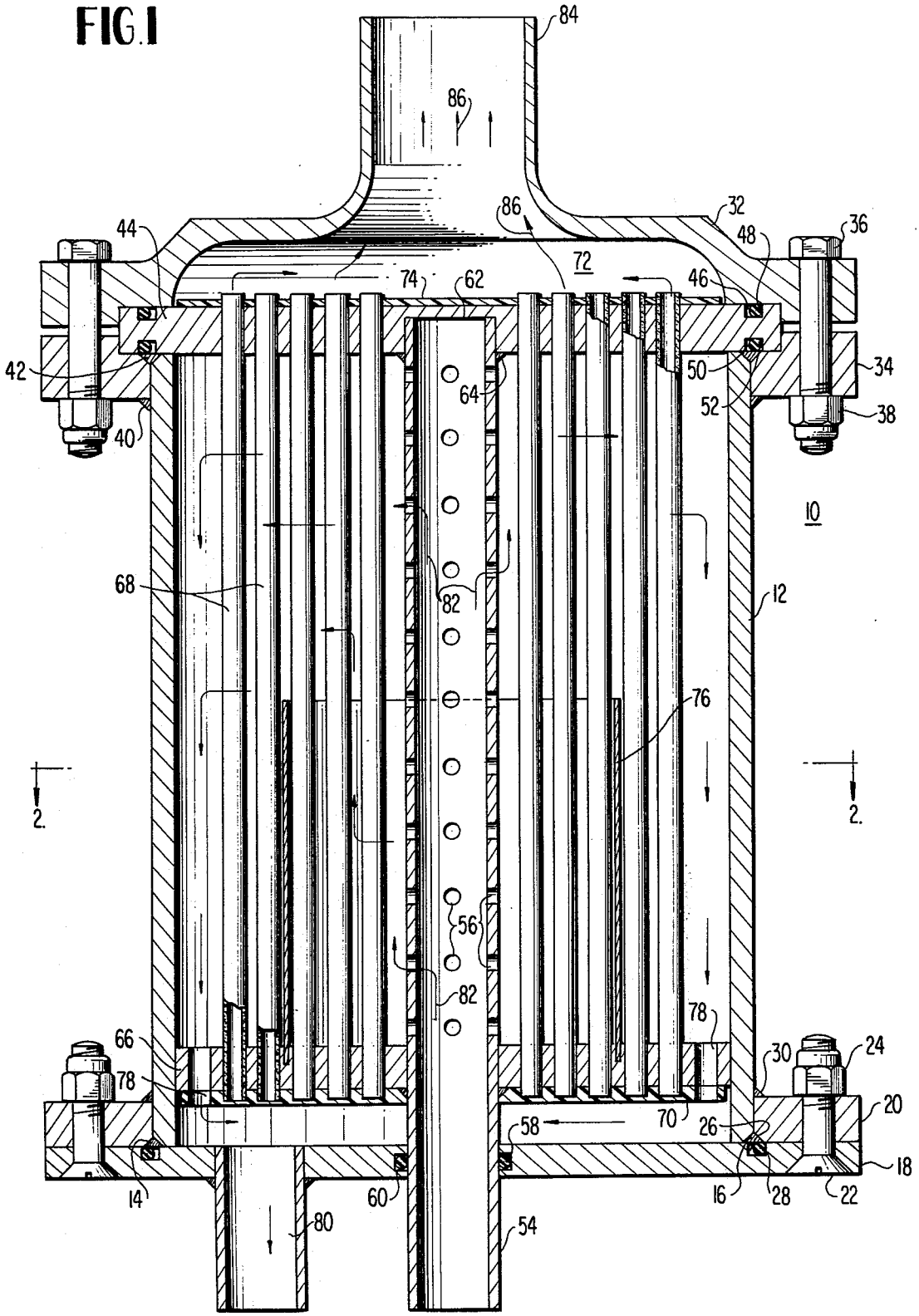
FIG. 1 is a cut away side view of the evaporator/sublimator heat sink.
Figure 2:
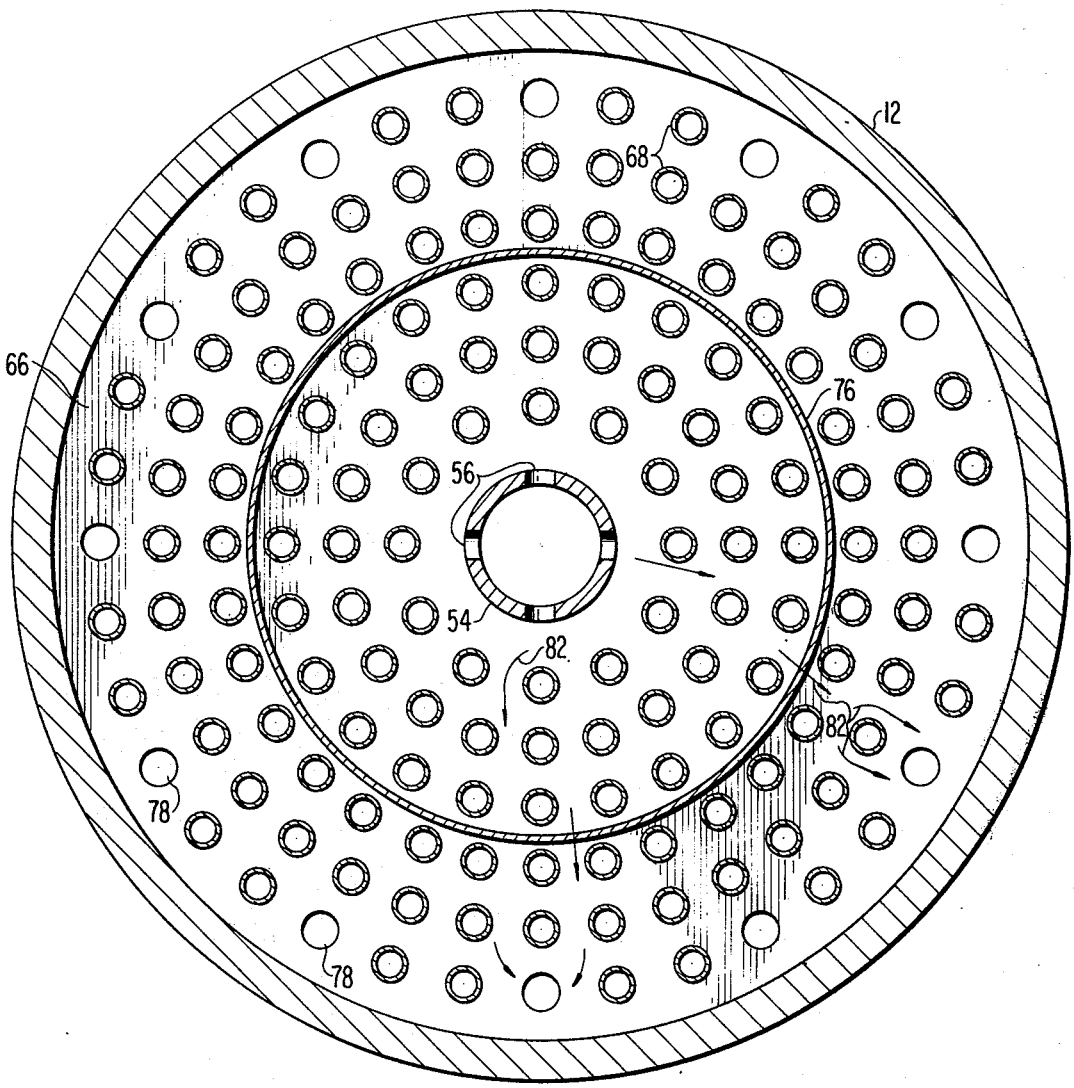
FIG. 2 is a top sectional view of the device of FIG. 1, cut along section line 2—2.

Referring now to FIGS. 1 and 2, the preferred embodiment to the evaporator/sublimator is shown. The device, generally indicated at 10, has an outer cylindrical casing 12 which is welded at 14 and 16 to a flange 20. Flange 20 is coupled to base 18 by a series of bolts 22 suitably tightened by nuts 24. The bolts are disposed about the perimeter of the base, typically about twelve in number. Additionally, disposed in a notch 26 in the flange 20, is an O-ring seal 28 to prevent leakage from the casing 12. If desired, a suitable fillet weld 30 may be utilized, typically by Heliarc techniques to further seal the casing 12.

The top section of the unit 10 has a cap 32 placed in a locking relationship with flange 34 by a series of bolts 36 tightened by nuts 38. As in the case of the base, the bolts 36 are disposed about the perimeter of the cap to uniformly couple the cap 32 to the casing 12. A fillet weld 40 joins flange 34 to the casing 12, and top plate 44 is joined to the casing and the flange by weld 42. A notch 46 in the top portion of the top plate 44 has an O-ring 48 to provide a seal between plate 44 and cap 32. Also, a lower notch 50 is provided with O-ring 52 to seal the top plate 44 and flange 34.

A fluid inlet tube 54 is positioned in the center of the device and has a number of flow passages 56 to effectuate the discharge of fluid to be cooled within the casing 12. A number of discrete levels of flow passages are provided, as shown. The tube 54 is sealed by means of O-ring 58 in notch 60 at the point where it passes through the flange plate 20 and has a sealed end 62 embedded in top plate 44. A weld 64 may also be employed to hold the tube 54 in position.

Disposed within casing 12, at the lower end, is a lower support plate 66 having a number of holes drilled to support a plurality of porous sublimator tubes 68. The sublimator tubes 68 can be fashioned from a number of porous or sintered materials well-known in the art. These tubes have their lower ends closed off and bedded with a layer of epoxy 70, and the upper ends protruding through top supporting plate 44 and exposed to the chamber 72 in the cap 32. An epoxy layer 74 bonds the tubes 68 to the plate 44. Typically, these tubes are disposed in a regular pattern, as shown in FIG. 2, and may number in the order of 150, depending on the particular design heat load.

A baffle can 76, whose function is to be described later, is disposed in the casing having its bottom end bedded in lower support plate 66. Means are also provided for the discharge of fluid from the system by discharge passages 78 emptying into outlet 80.

In operation, fluid, typically water, enters the unit through inlet 54 and is dispersed outward from ports 56 in the manner shown in the arrows 82. The outlet port 84 in cap 32 is coupled to a vacuum environment or source of low pressure, and therefore the interior of tubes 68 with an open end in chamber 72 are also coupled to the vacuum. Part of the liquid is evaporated through the porous tubes 68 as it circulates around. The vapor flow conditions in the tubes are such that a sonic, choked flow condition is maintained at the tube outlet. The device functions solely as an evaporator as long as the choked vapor outflow, shown by arrows 86, is sufficient to maintain the saturation pressure as the tube walls, upstream of the outlet, above the triple point of water (0.088 psia). Evaporation has a cooling effect on the circulating liquid discharged through outlet 80, and as the heat load is decreased, the vapor pressure drops and ice may form on all or a part of the tube walls. The presence of ice causes the device to function as a sublimator with the gas escape through discharge 84. During the sublimation phase, the temperature of the porous tube wall may drop to the point that ice forms on the liquid side of the tube. However, the configuration of the tube placement, coupled with the flow arrangement, is such that ice formation will not prevent continued circulation of the fluid. The resulting volume change in the device is accommodated by an accumulator in the liquid circulation loop. The baffle can 76 guarantees that fluid to be circulated will be dispensed throughout the casing 12.

The liquid flowing around the ice on the tubes is effectively cooled, and as the heat load is increased, the ice will melt. The device then functions as an evaporator. A simple shut off valve, not shown, at the vapor outlet port 84 is used to start and stop the operation.

Typically, a unit containing a bundle of 150 tubes, four inches long with ⅛ inch inside diameters, arbitrarily located on 0.200 inch centers, can reject from 400–2000 Btu/hr with liquid temperatures from 32° to 50° F. In this configuration, the required water permeation rate to reject the maximum heat load is approximately 1.7 lbm/hr-ft$^2$. A variety of tube wall materials such as sintered nickel, various membrane materials or plastic foams with supporting screens can be employed. The inside diameter of these tubes must be considerably larger than those used in prior art membrane evaporator/sublimator systems since they are required to flow vapor at a low pressure, rather than liquid.

The prime advantages provided by the invention thus described over prior art systems lie in the elimination of flow stoppage and breakage of tubes caused by freezing inside the tube of the liquid contained therein, and the elimination of a requirement for a vapor pressure controller previously needed to prevent this freezing.

It is to be understood that the invention is not limited to the specific embodiment herein illustrated and described, but may be used in other ways without departing from its spirit.

What is claimed is:

1. A self-regulating cooling system comprising:

a. a chamber having inlet means for the circulation of fluid to be cooled and outlet means for effectuating a discharge of cooled fluid;

b. a plurality of porous hollow heat exchangers disposed in said chamber, said porous hollow heat exchangers having one end thereof open and protruding through a wall of said chamber and another end sealed in said chamber;

c. means for coupling the open ends of said heat exchangers to a source of low pressure, thereby exposing the inner portions of said heat exchangers to said source of low pressure; and d. means within said chamber for channeling fluid to be cooled past said heat exchangers, whereby as fluid circulates in said chamber, a portion evaporates through said porous hollow heat exchangers, said system then functioning as a sublimator until the heat load due to circulation of fluid to be cooled increases, melting the ice such that evaporation then resumes.

2. The device of claim 1, wherein said chamber is circular and said inlet means is disposed in the center of the chamber to evenly distribute fluid to be cooled.

3. The device of claim 2, wherein said channeling means is a circular baffle disposed in said chamber around said inlet means.

4. The device of claim 3 wherein said porous hollow heat exchangers comprise a bundle of tubes disposed in a regular pattern in said chamber, and said outlet means is located around said bundle.

5. The device of claim 4, wherein said source of low pressure is the vacuum of outer space, and said means coupling the open ends of said heat exchangers is a plenum chamber vented to said source of low pressure.

6. The device of claim 5, wherein said fluid to be cooled is water.

7. The device of claim 5, wherein said fluid to be cooled is Freon.

8. A method of cooling fluid comprising the steps of:

a. circulating the fluid to be cooled in a chamber, said chamber having a plurality of hollow porous heat exchangers such that fluid, liquid or vapor is absorbed by said heat exchangers;

b. coupling the inside of said hollow porous heat exchangers to a source of low pressure;

c. evaporating fluid absorbed and venting the resulting vapor;

d. allowing ice to form on said heat exchanger as a result of evaporation such that sublimation occurs across said heat exchanger;

e. maintaining the volume of fluid in said chamber to melt said ice while cooling fluid to the point where the ice melts; and, f. repeating steps c through e repeatedly to cycle said cooling through evaporation and sublimation.

* * * * *